United States Patent [19]

Ramsay

[11] 4,181,165

[45] Jan. 1, 1980

[54] MANUFACTURE OF GOLF CLUB HEADS

[75] Inventor: John M. Ramsay, Hendersonville, Tenn.

[73] Assignee: True Temper Corporation, Cleveland, Ohio

[21] Appl. No.: 894,029

[22] Filed: Apr. 6, 1978

[51] Int. Cl.[2] ..... B27C 7/00; B27C 5/00

[52] U.S. Cl. ..... 144/325; 142/7; 144/2 XA

[58] Field of Search ..... 144/2 XA, 144 R, 144 A, 144/137, 144 B, 145 R, 145 A, 145B, 154, 325; 142/1, 3, 6, 7, 12, 13, 11; 82/14; 273/77 R, 167 R

[56] References Cited

U.S. PATENT DOCUMENTS

| | | | |
|---|---|---|---|
| 695,743 | 3/1902 | Lehmann | 142/11 |
| 1,628,617 | 5/1927 | Smith | 142/3 |
| 3,255,791 | 6/1966 | Garraffa | 142/7 X |
| 3,720,243 | 3/1973 | Schmidt | 142/7 |
| 3,863,691 | 2/1975 | Schmidt | 142/3 |
| 4,112,628 | 9/1978 | Schmidt | 142/7 |

FOREIGN PATENT DOCUMENTS

| | | | |
|---|---|---|---|
| 650444 | 1/1929 | France | 142/11 |

*Primary Examiner*—John Sipos
*Assistant Examiner*—W. D. Bray
*Attorney, Agent, or Firm*—Squire, Sanders & Dempsey

[57] ABSTRACT

A process is disclosed for forming the head of a golf club by rotating a blank, adapted to form the head, about an axis of rotation defined by the centerline of a bore in the blank that receives a shaft of the club. Controllable shaping means oriented with respect to the axis of rotation of the blank and disposed laterally thereof contacts and shapes the blank during its rotation.

15 Claims, 6 Drawing Figures

MANUFACTURE OF GOLF CLUB HEADS

BACKGROUND OF THE INVENTION

The present invention relates to the forming of heads for golf clubs that are fabricated from shapable or machinable materials, usually wood. Clubs with such heads are designed for driving a golf ball for relatively long distances and includes such clubs as a driver, brassie, or spoon, or clubs sometimes designated as drivers No. 1 through No. 4.

In general, a club head comprises a top curved surface, a leading striking face, a cylindrically curved opposed or rear surface, both the striking face and rear surface merging into an angled, upwardly extending hosel, and a bottom or sole to which a soleplate may be attached.

The shaping of a club head and especially its striking face in accordance with certain theoretical or practical considerations has been carried out in the past by hand as by filing, sanding, and other like cutting operations. These manufacturing techniques require the expertise of a skilled worker, are expensive, and even then lack reproducibility of results in the sense of repeating the same curvatures of surfaces from club to club. The more skilled golf players attach great importance to weight distribution and uniform reaction to a golf stroke against a ball, particularly in a so-called matched set of clubs which may differ only in the slant of the striking face. In a matched set, each club is especially adapted to meet the requirements of a particular stroke which the player may wish to make in the course of a round. Otherwise, the clubs have certain like characteristics which are preserved in all of the clubs of the set. It is most difficult and time-consuming for even the most skilled artisan to produce by hand a truly matched set of clubs. Inaccuracies are virtually certain to be present.

To overcome the disadvantages associated with manual shaping of a club head and particularly its striking face, machining of golf club heads has been suggested. Usually the head is held stationery or mounted for rectilinear movement while a shaping operation is performed on it. U.S. Pat. No. 1,675,437 to Waldron discloses holding the club grip or shaft stationery while applying pressure against the unfinished front face of the head to produce a predetermined moment relative to the grip. Because of the lateral and tortional flexibility of the shaft, this is said to bring about a movement of the club head into a corresponding deflected position so that the striking face is shaped accordingly.

U.S. Pat. No. 2,767,749 to Brandon discloses a machine for shaping golf club heads. The machine includes a carriage for the head having means for accurately locating it on the carriage in predetermined relation to cam means. The cam means has an operative surface corresponding to the transverse curvature of the head, so as to guide the carriage as it is moved over a supporting surface and into cooperative relationship with a cutting means which provides the required face on the club head.

U.S. Pat. No. 3,908,722 to Jacobs relates to precision machining of spherical faces of various radii and angles of loft on the hitting face of a golf club. The club head is adjustably mounted as to loft on an arm of adjustable radius with the club face centered relative to the axis of a rotatable milling cutter. The cutter has at least one radially offset bit, and the arm is swung on a selected radius to cause the club face to traverse the cutter and generate a spherical milled surface on the face.

It has been proposed to rotate a curved blank while a club head is formed from it. The axis of rotation for such an operation extends from the toe of the blank, across the bend of the curve (actually passing outside the body of the blank), and then through a hosel section. Problems have arisen in this technique, because it is difficult to establish a center of reference which is accurate for the shaping all of the various surfaces (as distinct from just the striking face) into their finished form. Also, as a final step in this prior operation, an opening was placed in the hosel, and it was most difficult to place this opening at an angle which insured the other surfaces of the head being in the exact, same frame of reference relating thereto as may be desired. With no positive or precision orientation of golf club heads as previously produced by turning the head, the matching of a set of clubs was still more of an art than a science and considerable losses resulted from this type of operation.

SUMMARY OF THE INVENTION

The principal object of the present invention is to provide an improved process for generating a golf club head. In general, a blank of shapable material is rotated about an axis that is coincident with the center axis of a shaft adapted to be subsequently secured to the head shaped from the blank. Shaping means disposed laterally of and with respect to the axis of rotation engages the blank during its rotation to form the head.

In one form of the invention, a golf club head having a hosel and sole may be formed from a block of shapable material such as wood defining a blank by precision drilling a bore in the blank at a section adapted to form the hosel of the head, such bore being adapted to receive a shaft for the golf club. The bore may extend entirely through the blank, or the bore may extend only partially into the blank and a second bore may be drilled in the blank at a section adapted to form the sole of the head in co-axial alignment with the bore in the hosel. In either case, a rotatable member engages the open bore ends to rotate the blank about an axis that is the centerline of the bore or bores. Shaping cutter means are aligned adjacent the blank with respect to the centerline axis of rotation and contact the blank as it rotates. The cutting action of the cutter means is controlled to form a golf club head of desired dimensions. Preferably, the cutting means are controlled by a copy lathe technique. By this controlled turning of the blank, each head produced is the same in accordance with the controlled action of the cutting means.

DESCRIPTION OF THE PREFERRED EMBODIMENTS

As indicated, the present process includes orienting a golf head blank so that it rotates about an axis defined by the center-line of a shaft hole or bore in the head, and then shaping the blank by controllable shaping means as the blank is forceably rotated about such axis. The bore which defines the axis of rotation can be formed by drilling entirely through the blank; or the bore can be formed by separated but opposed and co-axial bores. The shaping operation can leave a knob on the sole of the resulting head which can be readily removed as by planing.

Figure 1:
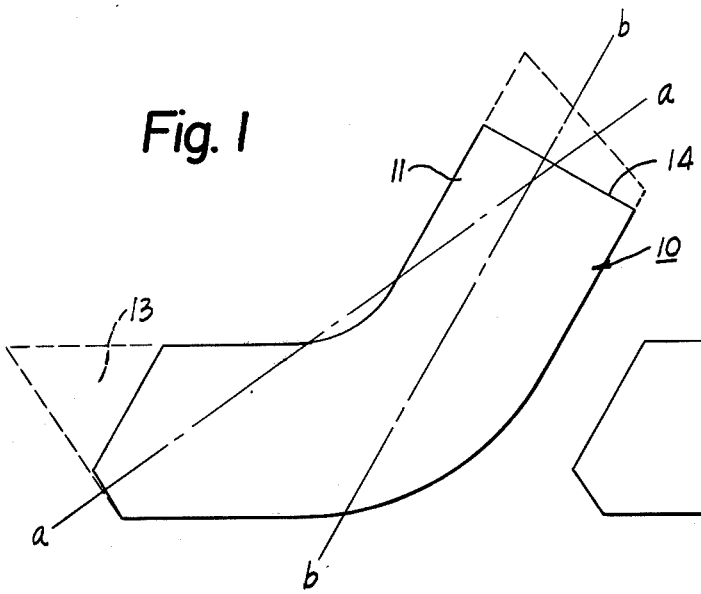
FIG. 1 is a side view of a blank from which a golf club head may be formed and illustrates how the axis of rotation used in forming the present head differs from prior practice.
Figure 2:
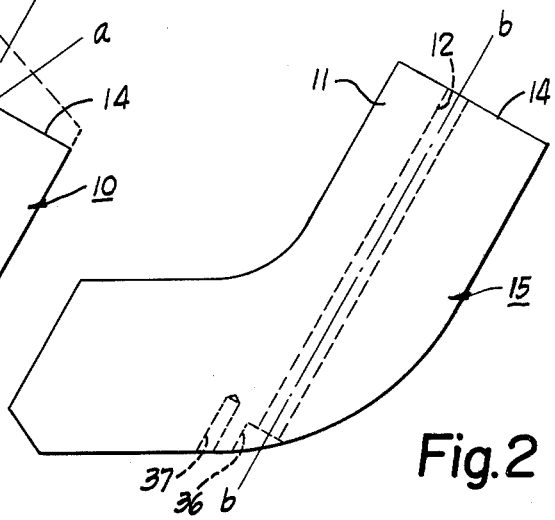
FIG. 2 is a side view of a blank similar to FIG. 1 but shows a precision drilled bore in the blank forming an axis of rotation about which the blank is turned.

Referring to the drawing, a curved block of FIG. 1 represents a blank 10 from which a golf club head may be formed. The blank is bent to a shape roughly conforming to the normal angle between the striking face and hosel of a golf club head. The blank itself may be fabricated from any shapable material such as plastic or metal but is preferably wood. For example, blank 10 can be constructed of wood laminations bonded together and bent to form the angle as described with the grains of each lamination being oppositely disposed, as disclosed in U.S. Pat. No. 3,591,183 to Ford. Blank 10 is of general rectangular cross-section throughout its length, although the upper or hosel section 11 has a narrower width and one face tends to be coplanar with a lower face of the blank, these two faces lying in the plane of the sheet of drawing in FIG. 1.

Where club heads were previously made by rotating a blank, the rotation has been about an axis indicated by the line a—a in FIG. 1. This axis extends from the toe of the blank, across the bend in which it actually passes outside the body of the blank, and then through the hosel. This technique has lead to various manufacturing problems, primarily because there is no center of reference which is accurate for shaping all of the various surfaces (as distinct from just the striking face) into their finished form. In contrast to this, the present process uses another axis of rotation, namely, one illustrated at b—b in FIG. 1 which is defined in practice by a predrilled, precision bore extending into the blank, that bore serving later to receive the shaft of the golf club.

Referring principally to the embodiment of FIGS. 2 through 5, before any major forming or shaping operation is carried out on a blank, a bore 12 is precision-drilled entirely through the blank. The centerline of bore 12 in FIG. 2 defines axis b—b of FIG. 1 and forms the axis of rotation when the blank is subsequently rotated and shaped. Bore 12 also receives a shaft of the golf club (not shown) which can be conventionally secured to the head after it is removed. A toe 13 of blank 10 may be removed as by sawing, and after drilling of bore 12 a section of the hosel may be cut so as to leave a surface 14 that is at right angles to the the centerline axis of bore 12. This leaves a somewhat preshapened blank 15 which is now ready for major shaping. By predrilling a shaft hole or bore, subsequent manufacturing losses due to mislocated shaft holes, necking down of the hosel, and reshaping of the nose and mismatched heads is eliminated.

Figure 3:
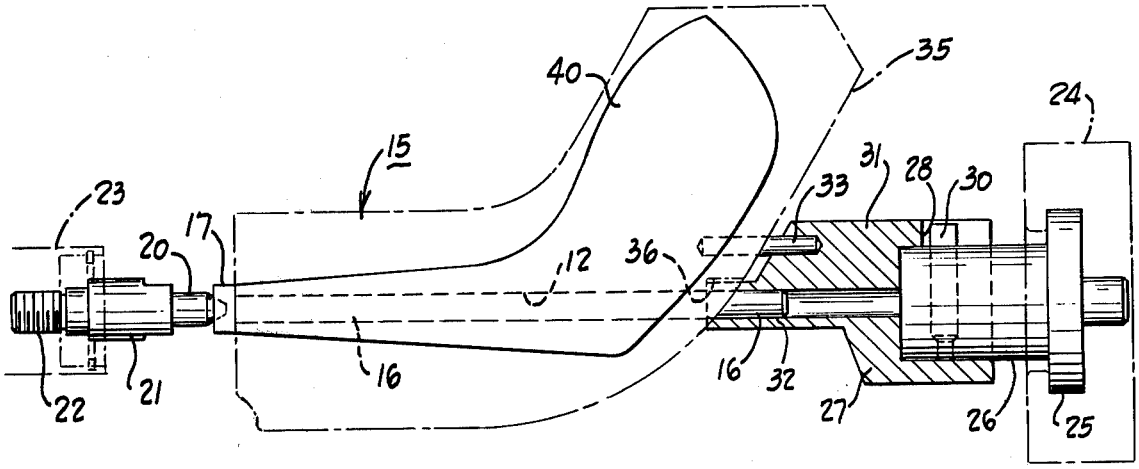
FIG. 3 is a side view of the blank of FIG. 2 mounted for rotation with bore-engaging rotatable elements, the blank being shown by dot-dash lines, the head formed therefrom being shown by solid lines.
Figure 4:
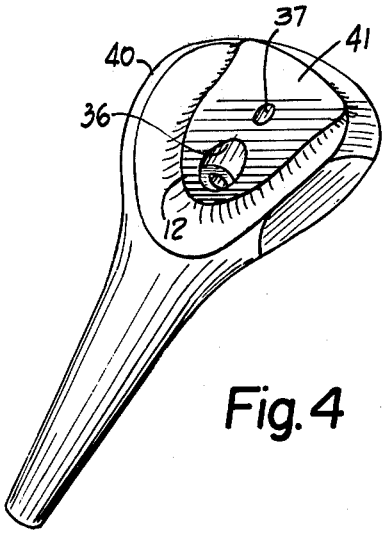
FIG. 4 is a bottom perspective view of a head formed by the assembly of FIG. 3 and shows a knob remaining on the sole of the head.

FIG. 3 illustrates one rotatable mounting that can be used for blank 15. A mandrel 16 extends through bore 12 and preferably makes a sufficient frictional contact with blank 15 to rotate with it. Mandrel 16 has a collar 17 provided with an access hole 18 into which a centering pin 20 presses. A fitting 21 is integral with pin 20 and engages a threaded opening 22 in a housing 23 conventionally mounted for rotation.

A drive assembly engages the opposite end of mandrel 16 and includes a driven coupling member 24 having a recess to receive a flange 25 of snub shaft 26. Coupling member 24 can be rotated by any suitable prime mover such as an electric motor. A cap 27 telescopes about snub shaft 26 and has a slot 28 to receive a dowel pin 30 fixed to snub shaft 26 which thereby locks the shaft 26 and cap 27 in common rotation. Cap 27 has an axially extending connecting portion 31 terminating in a nose 32 and a radially offset drive pin 33. Nose 32 has a bore 34 which receives the other end of mandrel 16, and for this purpose the sole end 35 of blank 15 is counter-bored at 36 for a short distance and at a greater diameter than bore 12 to receive nose 32 of cap 27. Similarly, sole end 35 has a relatively small bore 37 to receive drive pin 33. Pin 33 is parallel to bores 12 and 34, and the centerlines or center axes of all three lie in the same plane.

While the assembly of FIG. 3 is rotated, the blank, shown for purposes of illustration by dot-dash lines, is formed or shaped to the design of a golf club head 40, shown for purposes of illustration by solid lines. Bore 37 and its pin 33 consistently fix the blank at the same angular position around the axis of bore 12, and the end of the hosel locks the position of the blank on this axis. By using the resulting three axis coordinate system, the golf club head can be defined precisely, located accurately, and positively and repeatedly reproduced for all heads made by the system.

The shaping of blank 15 can be carried out by any desired means, such as milling. It is preferred to use controllable shaping means, and the best mode of this technique, presently known, is to use a copy lathe operation from a master model, such as a Richardson copy lathe. In this method of shaping, the outline of a master model of the golf head, which can be made of brass, is traced by the shaping means so as to turn the blank into a matching configuration.

Figure 5:
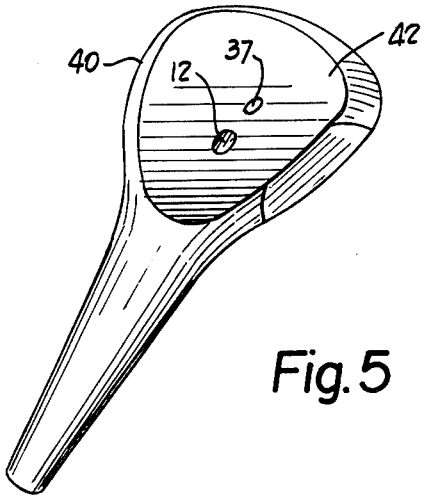
FIG. 5 is a bottom perspective view of the head of FIG. 4 with the knob removed.

After head 40 has been shaped, a knob formation 41 (FIG. 4) remains on the sole portion of the head. This can be easily removed by planing, leaving a smooth sole 42 (FIG. 5). Bores 12 and 37 remain. These may be plugged if desired or left open. In either case, a soleplate (not shown) may be conventionally attached to sole 42, if desired.

Figure 6:
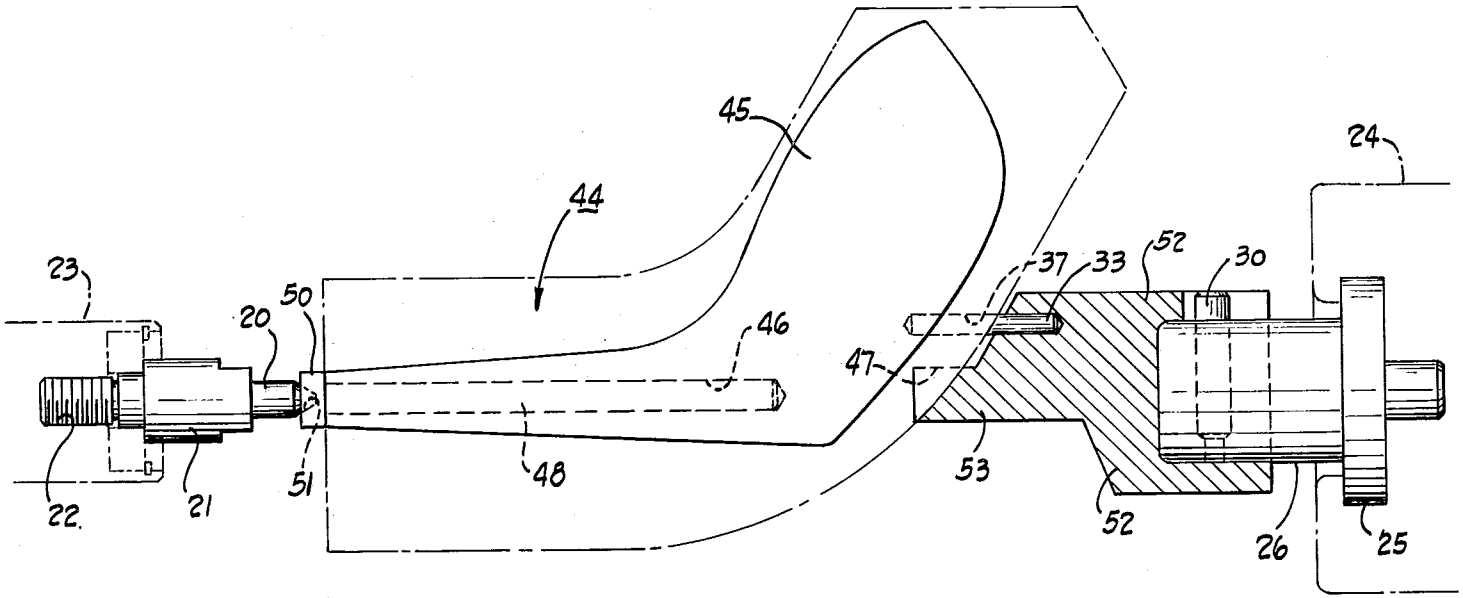
FIG. 6 is a side view of a blank, similar to FIG. 3, but illustrates the use of separate but aligned bores drilled from opposite sides of the blank.

Certain golf manufacturers make a club head by inserting the shaft into a blind hole. Since the centerline of the shaft is important to the present process as the axis of rotation as described, the process can be adapted to this manufacturing procedure as well. FIG. 6 illustrates a rotatable assembly, similar to FIG. 3, but modified to receive a blank 44 which does not have a through bore.

More particularly, referring to FIG. 6, the left-hand portion is of similar construction to that shown by FIG. 3 and, therefore, the same reference numerals have been used to refer to like parts. In this embodiment, blank 44 from which head 45 is to be formed has a precision drilled bore 46 which extends for an appreciable distance into blank 44 but not entirely through it. A second, opposite, and co-axial bore 47 is precision drilled into the sole end of blank 44. A mandrel 48 of about the same length as bore 46 fits into the bore and has a collar 50 provided with an access hole 51 to receive centering pin 20.

The right-hand portion of the assembly of FIG. 6 is also similar to that of FIG. 3 and, therefore, the same reference numerals have been used to refer to like parts, except for a cap 52. A nose 53 of the cap is solid and fits into bore 47. When the assembly of FIG. 6 is rotated, head 45 is formed from blank 44 by any of the shaping techniques described for FIG. 3.

The described process may be used for all machining and finishing operations. The bore along the sole ends of the blanks acts as a reference point for all subsequent operations.

In addition to the advantages previously noted, club heads produced in accordance with the present process have a well-defined sole line and a clearer than the usual carving on the crown of the head. Clubs having the present heads are well balanced and adapted to provide long drives.

Although the foregoing describes several preferred embodiments of the present invention, it is understood that the invention may be practiced in still other forms within the scope of the following claims.

I claim:

1. In a process for forming from a blank a golf club head having a hosel for receiving a golf club shaft, the improvement comprising: rotating said blank about an axis of rotation which passes through the section of said blank for forming said hosel and which is coincident with the centerline axis along which said golf club shaft is to be secured to said golf club head, and forming said golf club head by contacting said blank with a shaping means as said blank is rotated.

2. A process for forming a head for a golf club from a blank, said process comprising the steps of: forming a bore in said blank for receiving a shaft for said golf club, rotating said blank about the centerline axis of said bore, and moving shaping means transversely of said blank and in contact with said blank to form said golf club head.

3. The process of claim 2 in which said bore extends partially through said blank, and including forming a second bore on an opposite side of said blank in co-axial alignment with said first bore, and engaging openings of said bores with rotatable members to effect said rotation.

4. A process for forming a golf club head from a blank, said process comprising the steps of: forming a bore entirely through said blank for receiving the golf shaft, rotating said blank about the centerline axis of said bore by engaging opposite openings of said bore with rotatable members, and moving shaping means transversely of said blank and in contact with said blank to form said golf club head.

5. The process of claims 2, 3, or 4 in which said blank is wood.

6. The process of claims 2, 3, or 4 in which said shaping operation includes milling.

7. The process of claims 2, 4, or 3 in which the step of moving shaping means includes forming a knob formation on a side of said blank, and removing said knob formation to form a sole of said club head.

8. The process of claims 2, 3, or 4 in which said shaping operation leaves a bore opening on the sole of said club head, and plugging said bore opening.

9. The process of claims 2, 3, or 4 in which said shaping operation is carried out by a copy lathe operation.

10. A precision process for forming a head for a golf club from a blank defining a blank, said head having a hosel and sole, said process comprising the steps of: drilling a golf club shaft receiving bore in said blank at a section adapted to form the hosel of the head, cutting off said blank at said hosel section at substantially right angles to the centerline axis of said bore, drilling a bore in said blank at a section adapted to form the sole of the head and in co-axial alignment with the bore in said hosel section, engaging a rotatable member in the end of each bore and rotating the blank about the centerline axis of the bores, contacting the blank with a shaping cutter means as the blank rotates, and controlling the cutting action of said cutter means to form said golf club head.

11. The process of claim 10 in which said two bores are drilled sequentially from said hosel and sole ends.

12. A precision process for forming a head for a golf club from a blank, said head having a hosel and sole, comprising the steps of: drilling a golf club shaft receiving bore entirely through the sections of said blank adapted to form said hosel and said sole of said golf club head, cutting off said blank at said hosel section at substantially right angles to the centerline axis of said bore, rotating the blank about said centerline axis, contacting the blank with a shaping cutter means as the blank rotates, and controlling the cutting action of said cutter means to form said golf club head.

13. The process of claim 4, 3, 10, or 12, further comprising drilling in said blank a bore offset from said axis of rotation, and positioning said blank in a preselected relationship to at least one of said rotatable members by inserting into said offset bore a pin formed on said one of said rotatable members.

14. The process of claims 10 or 12 in which said shaping cutter means are controlled in a copy lathe operation from a master model.

15. The process of claim 12 wherein said bore is drilled from the hosel toward the sole.

* * * * *